US006113221A

United States Patent [19]

Weber

[11] Patent Number: 6,113,221

[45] **Date of Patent: *Sep. 5, 2000**

[54] METHOD AND APPARATUS FOR INK CHAMBER EVACUATION

[75] Inventor: Timothy L. Weber, Corvallis, Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/738,516

[22] Filed: Oct. 28, 1996

Related U.S. Application Data

[63] Continuation-in-part of application No. 08/597,746, Feb. 7, 1996.

[51] Int. Cl.[7] ..... B41J 2/05

[52] U.S. Cl. ..... 347/61

[58] Field of Search ..... 347/61–63, 65

[56] References Cited

U.S. PATENT DOCUMENTS

| | | | |
|---|---|---|---|
| 4,278,983 | 7/1981 | Halasz | 347/47 |
| 4,438,191 | 3/1984 | Cloutier et al. | 430/324 |
| 4,463,359 | 7/1984 | Ayata et al. | 347/56 |
| 4,502,060 | 2/1985 | Rankin et al. | 346/140 R |
| 4,513,298 | 4/1985 | Scheu | 346/140 R |
| 4,528,574 | 7/1985 | Boyden | 346/140 R |
| 4,528,577 | 7/1985 | Cloutier et al. | 346/140 R |
| 4,578,687 | 3/1986 | Cloutier et al. | 346/140 R |
| 4,680,859 | 7/1987 | Johnson | 29/611 |
| 4,683,481 | 7/1987 | Johnson | 346/140 R |
| 4,694,308 | 9/1987 | Chan et al. | 346/140 R |
| 4,794,411 | 12/1988 | Taub et al. | 346/140 R |
| 4,847,630 | 7/1989 | Bhaskar et al. | 346/1.1 |
| 4,882,595 | 11/1989 | Trueba et al. | 346/140 R |
| 4,894,664 | 1/1990 | Tsung Pan | 346/1.1 |
| 4,947,193 | 8/1990 | Deshpande | 346/140 R |
| 4,965,610 | 10/1990 | Ishikawa | 347/61 |
| 5,016,024 | 5/1991 | Lam et al. | 346/1.1 |
| 5,194,877 | 3/1993 | Lam et al. | 346/1.1 |
| 5,218,376 | 6/1993 | Asai | 347/61 |
| 5,229,785 | 7/1993 | Leban | 346/1.1 |
| 5,278,584 | 1/1994 | Keefe et al. | 347/63 |
| 5,291,226 | 3/1994 | Schantz et al. | 346/140 R |
| 5,442,384 | 8/1995 | Schantz et al. | 346/20 |
| 5,754,202 | 5/1998 | Sekiya et al. | 347/63 |
| 5,793,393 | 8/1998 | Coven | 347/65 |

FOREIGN PATENT DOCUMENTS

| | | | |
|---|---|---|---|
| 641 654A | 3/1995 | European Pat. Off. | B41J 2/14 |
| 654 353A | 5/1995 | European Pat. Off. . | |
| 19505465A | 8/1995 | Germany . | |

OTHER PUBLICATIONS

Hewlett–Packard Journal, Oct. 1988, "Development Of A High–Resolution Thermal Inkjet Printhead", William A. Buskirk, David E. Hackleman, Stanley T. Hall, Paula H. Kanarek, Robert N. Low, Kenneth E. Trueba, and Richard R. Van de Poll, pp. 55–61.

Hewlett–Packard Journal, May 1985, "Thermodynamics And Hydrodynamics Of Thermal Ink Jets", Ross R. Allen, John D. Meyer, and William R. Knight, pp. 21–27.

*Primary Examiner*—John Barlow
*Assistant Examiner*—Michael S Brooke
*Attorney, Agent, or Firm*—Kevin B. Sullivan

[57] ABSTRACT

The present invention is a printhead for ejecting fluid droplets. The printhead includes a chamber member defining a chamber. The chamber member has a chamber volume associated therewith. The chamber member defines an orifice and a fluid inlet through which fluid flows to the chamber. Also included is a heating member for heating fluid within the chamber. The chamber ejects a fluid droplet having a volume equal to the chamber volume in response to activation of the heating member.

14 Claims, 4 Drawing Sheets

METHOD AND APPARATUS FOR INK CHAMBER EVACUATION

CROSS REFERENCES TO CO-PENDING APPLICATION

This application is a continuation-in-part of application entitled "SOLID STATE INK JET PRINT HEAD AND METHOD OF MANUFACTURE" Ser. No. 08/597,746 filed Feb. 7, 1996, incorporated herein by reference.

BACKGROUND OF THE INVENTION

The present invention relates to inkjet printing. More particularly, the present invention relates to a method and apparatus for evacuating an ink chamber for an inkjet printhead.

An inkjet printer for inkjet printing includes a pen in which small droplets of ink are formed and ejected towards a print medium. Such pens include a printhead having an orifice member or plate that has a plurality of small orifices through which ink droplets are ejected. Adjacent to the orifices are ink chambers, where ink resides prior to ejection through the orifice. Ink is delivered to the ink chambers through ink channels that are in fluid communication with an ink supply. The ink supply may be contained in a reservoir portion of the pen or in a separate ink container spaced from the printhead in the case of "off-axis" ink supplies.

Ejection of an ink droplet through an orifice may be accomplished by quickly heating a volume of ink within the adjacent ink chamber. This thermal process causes ink within the chamber to super heat and form a vapor bubble. Formation of the vapor bubble is known as "nucleation". The rapid expansion of the bubble forces ink through the orifice. This process is sometimes referred to as "firing". The ink in the chamber is typically heated using a resistive heating element which is positioned within the chamber.

Once ink is ejected, the ink chamber is refilled with ink from an ink channel which is in fluid communication with the ink chamber. The ink channel is typically sized to refill the ink chamber quickly to maximize print speed. Ink channel damping is sometimes provided to dampen or control inertia of the moving ink flowing into and out of the chamber. By damping the ink flow between the ink channel and the ink chamber underfilling and overfilling of the ink chamber resulting in meniscus recoiling and bulging, respectively, can be avoided or minimized.

As the vapor bubble expands within the ink chamber the expanding vapor bubble can extend into the ink channel. Expansion of the vapor bubble into the ink chamber is known as "blowback". Blowback tends to result in forcing ink in the ink channel away from the ink chamber. The volume of ink which the bubble displaces is accounted for by both the ink ejected from the nozzle and ink which is forced down the ink channel away from the ink chamber. Therefore, blowback increases the amount of energy necessary for ejecting droplets of a given size from the ink chamber. The energy required to eject a drop of a given size is referred to as "Turn-On Energy" (TOE). Printheads having high turn-on energies tend to be less efficient and therefore, have more heat to dissipate than lower turn-on energy printheads. Assuming a given ability to dissipate heat then printheads that have a higher thermal efficiency are capable of a higher printing speed or printing frequency than printheads which have a lower thermal efficiency.

The turn-on energy is a sufficient amount of energy to form a vapor bubble having sufficient size to eject a predetermined amount of ink from the printhead orifice. The vapor bubble then collapses back into the ink chamber. Components within the printhead in the vicinity of the vapor bubble collapse are susceptible to cavitation stresses as the vapor bubble collapses between firing intervals. Particularly susceptible to damage from cavitation is the heating element or resistor. A thin protective passivation layer is typically applied over the resistor to protect the resistor from stresses resulting from cavitation. A problem with the use of a passivation layer for preventing or limiting cavitation damage is that this passivation layer tends to increase the turn-on energy required for ejecting droplets of a given size.

There is an ever present need for printheads which have a high thermal efficiency and are capable of printing at high print frequencies. These printheads should be reliable and capable of extended printing without failure. In addition, these printheads should be relatively easily manufactured so that the overall cost of the printhead is relatively low.

Finally, these printheads should be capable of forming high quality images on print media. These printheads should be capable of forming droplets having the same or nearly the same drop volume over a wide variety of inks used in the printhead. For example, the printhead should be capable of providing a selected droplets volume regardless of the ink surface tension or the ink viscosity. This allows the same printhead to be used for a variety of different printing applications. In addition, the droplets formed by the printhead should not have tails which tend to result in splattering, puddling and generally poor image quality. Furthermore, these printheads should be capable of minimal trajectory errors which tend to result when the ink droplets are not well defined during ejection.

SUMMARY OF THE INVENTION

The present invention is a printhead and method of operating the same for ejecting fluid droplets. The printhead includes a chamber member defining a chamber. The chamber member has a chamber volume associated therewith. The chamber member defines an orifice and a fluid inlet through which fluid flows to the chamber. Also included is a heating member for heating fluid within the chamber. The chamber ejects a fluid droplet having a volume equal to the chamber volume in response to activation of the heating member.

In one preferred embodiment, the heating member is a resistive heating element that has an area associated therewith that is large relative to the chamber volume. In this preferred embodiment the orifice has an opening size that is large relative to an opening size associated with the fluid inlet.

DETAILED DESCRIPTION OF THE PREFERRED EMBODIMENT

Figure 1:
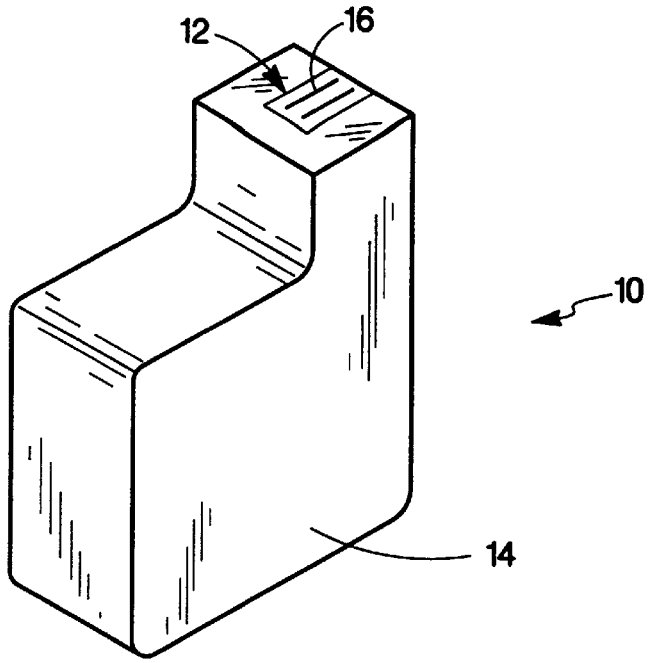
FIG. 1 is a perspective of an ink jet printhead that incorporates a printhead that is configured and operated for evacuating the ink chamber according to the present invention.

FIG. 1 depicts an inkjet pen that incorporates a printhead 12 that is configured and arranged for carrying out the present invention. A preferred embodiment of the pen 10 includes a pen body 14 that defines an internal reservoir for holding a supply of fluid such as ink. Fluid is ejected from the printhead 12 through a plurality of orifices 16 that are in fluid communication with the supply of fluid within the pen body 14. Alternatively, fluid can be provided to the printhead 12 by an fluid supply spaced from the printhead 12 as in the case of off-axis ink supplies.

Figure 2A:
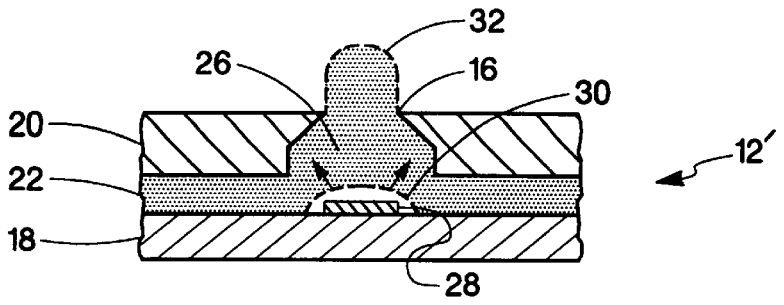
FIG. 2a (PRIOR ART)
FIGS. 2*a,* 2*b,* and 2*c* are sectional views illustrating a drop ejection sequence for a printhead whereby the vapor bubble collapses within the ink chamber after drop ejection.

Before discussing the printhead 12 of the present invention it will be helpful to first discuss a previously used printhead 12' and a method of operation for the printhead 12' shown in FIGS. 2*a,* 2*b,* and 2*c.* The printhead 12' is not drawn to scale nor is it intended to accurately represent the printhead 12' structure. The printhead 12' shown in FIGS. 2*a,* 2*b,* and 2*c* at a series of time intervals to illustrate a drop ejection sequence for the printhead 12'.

Printhead 12' includes a substrate 18, orifice member 20 and a fluid channel 22. The orifice member 20 defines an orifice 16 from which fluid is ejected. The substrate 18, fluid channels 22, and orifice member 20 all define an fluid chamber 26. Positioned proximate the fluid chamber 26 is a heating element 28.

FIG. 2*a* depicts formation of a vapor bubble having a bubble front 30 represented by dashed lines. The vapor bubble is formed soon after activation of the heating element 28. During bubble formation the bubble front 30 expands radially from the heating element 28 into the fluid chamber 26. As the vapor bubble having bubble front 30 expands into the fluid chamber 26, fluid within the chamber 26 is displaced forcing fluid through the orifice 16 forming a droplet 32.

Figure 2B:
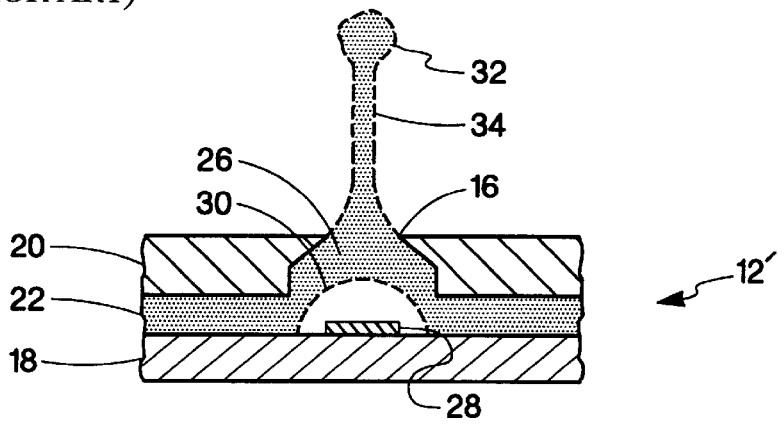
FIG. 2b (PRIOR ART)

FIG. 2*b* depicts the bubble ejection sequence a short time after the representation in FIG. 2*a*. In this plot the bubble front 30 has reached its maximum size of radial separation from the heating element 28 and begins to collapse back towards the heating element 28. The droplet 32 as it emerges from the orifice 16 is connected by a long streamer 34. The streamer 34 results from the surface tension and the viscosity of the fluid. The streamer 34 tends to elasticly bind the droplet 32 to the printhead 12'.

Figure 2C:
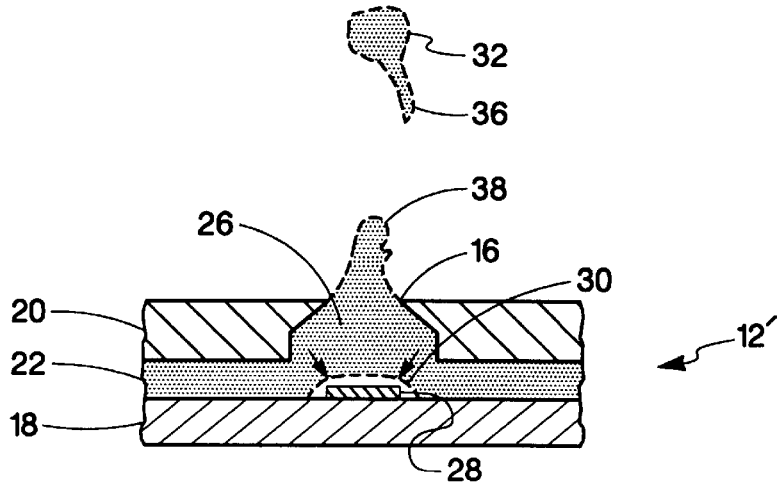
FIG. 2c (PRIOR ART)

FIG. 2*c* depicts the printhead 12' drop ejection sequence shortly after the diagram shown in FIG. 2*b*. The bubble front 30 has nearly collapsed back on the heating element 28. The collapse of the bubble front 30 results in a velocity gradient in the region near the orifice exit plane which tends to break the streamer 34 and release the droplet 32. The droplet 32 has a tail 36 resulting from the severed streamer 34. The remaining portion 38 of the streamer 34 is drawn back into the orifice 16 by the collapsing bubble front 30.

Figure 3A:
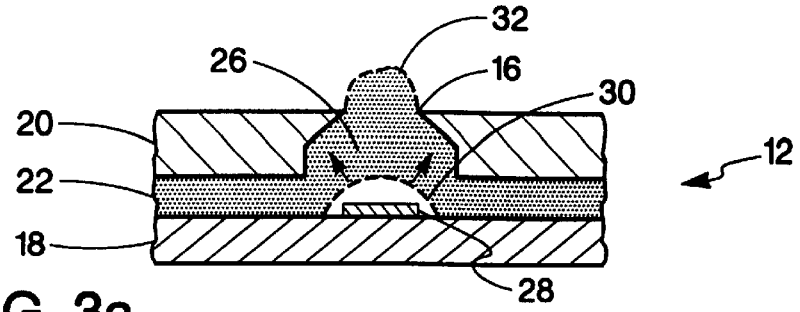
FIGS. 3*a,* 3*b,* 3*c* and 3*d* is a sectional view of drop ejection sequence for the printhead of the present invention whereby the vapor bubble is vented to the atmosphere.

FIGS. 3*a,* 3*b,* 3*c* and 3*d* depict a simplified representation of the printhead 12 of the present invention at a series of intervals to illustrate the drop ejection method of the present invention. FIGS. 3*a*–3*d* are not drawn to scale nor are these figures intended to represent an actual printhead 12 but are merely intended to illustrate the technique of the present invention for forming fluid droplets 32.

FIG. 3*a* depicts the printhead 12 of the present invention which includes a substrate 18, an orifice member 20, and an fluid inlet 22. The orifice member 20 defines an orifice 16. The substrate 18, orifice member 20 and fluid inlet 22 all define a fluid chamber 26. A heating element 28 is positioned proximate the fluid chamber 26. The printhead 12 is shown soon after activation of the heating element 28. Heating of the fluid within the chamber forms a vapor bubble proximate the heating element 28. The vapor bubble has a bubble front 30, represented by dashed lines, that expands outwardly in a generally radial direction from the heating element 28. The expanding bubble front 30 begins to displace fluid within the chamber 26 forcing fluid through the orifice 16. A droplet 32 begins to emerge from the orifice 16 as fluid is forced through the orifice 16.

Figure 3B:
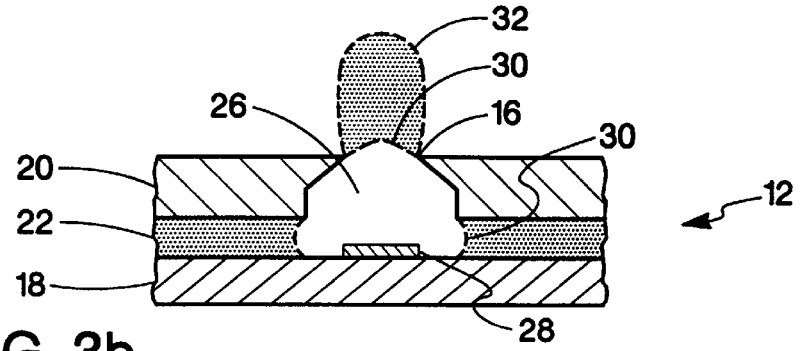

FIG. 3*b* depicts further growth of the vapor bubble having the bubble front 30. The bubble front 30 expands radially from the heating element 28 into the fluid chamber 26. As the bubble front 30 grows into the chamber 26 the fluid within the chamber is displaced by the vapor bubble resulting in the emergence of the droplet 32 from the orifice 16. The vapor bubble front 30 expands through a plane of the orifice 16 and is vented to an atmosphere surrounding the printhead 12. During the bubble expansion sequence of FIGS. 3*a* and 3*b* substantially all or most of the displaced fluid is ejected through the orifice 16 as represented in FIG. 3*b*. Therefore, the volume of the fluid droplet 32 is substantially equal to the volume of the fluid chamber 26.

A relatively small amount of the fluid in chamber 26 may be forced into the fluid inlet 22. The printhead 12 of the present invention is selected to have a fluid resistance of the orifice 16 that is small relative to a fluid resistance of the fluid inlet 22 so that most of the chamber fluid is forced through the orifice 16. One factor affecting the fluid resistance is the size of the fluid openings for the orifice 16 and the fluid inlet 22. Because the ratio of orifice size 16 is large relative to the size of the fluid inlet 22 for the printhead 12 of the present invention a majority of the displaced fluid is ejected through orifice 16. Other factors that affect the fluid resistance of the fluid inlet 22 and the orifice 16 is back-pressure provided by the fluid inlet or atmosphere as well as flow impediments that change the fluid flow direction.

Figure 3C:
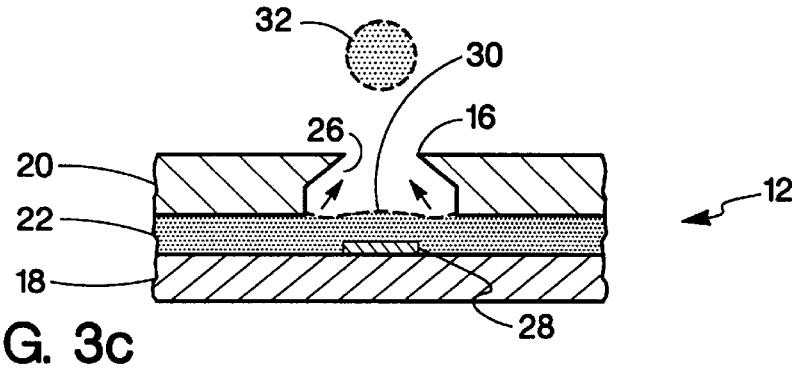
Figure 3D:
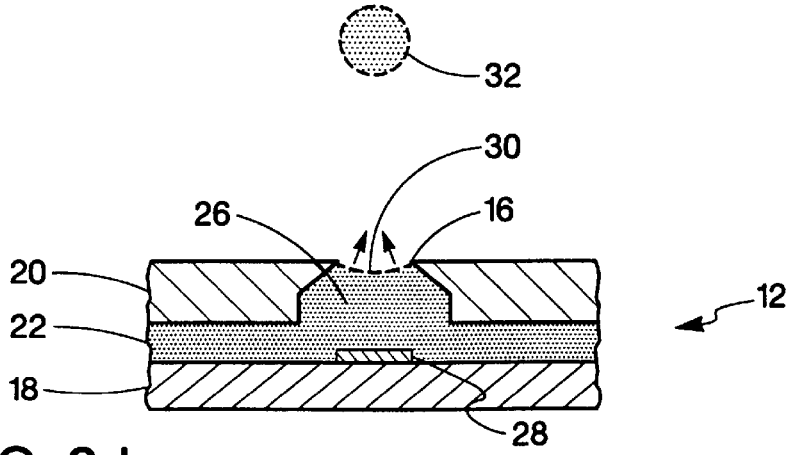

FIG. 3*c* depicts the printhead 12 drop ejection sequence a short time after the representation shown in FIG. 3*b*. After the bubble front 30 has passed through the plane of the orifice 16 the vapor bubble vents to the atmosphere. The venting of the vapor bubble tends to result in relatively high drop velocity for the droplet 32. Because the ejected droplet 32 has a high velocity gradient, the droplet 32 is able to overcome surface tension and the viscosity of the fluid preventing the formation of a streamer 34 as shown in FIG. 2*b*. The streamer 34 tends to reduce the drop velocity by elastically binding the droplet 32 to the printhead 12. Because the streamer 34 is not formed the droplet continues on a trajectory toward print media at a high drop velocity. The droplet 32 that is formed by the printhead 12 tends to be a single, spherically shaped droplet 32 as shown in FIGS. 3*c* and 3*d*. Once the bubble has vented, fluid from the fluid inlet 22 flows into the chamber 26 refilling the chamber 26 as shown in FIGS. 3*c* and 3*d*.

Figure 4:
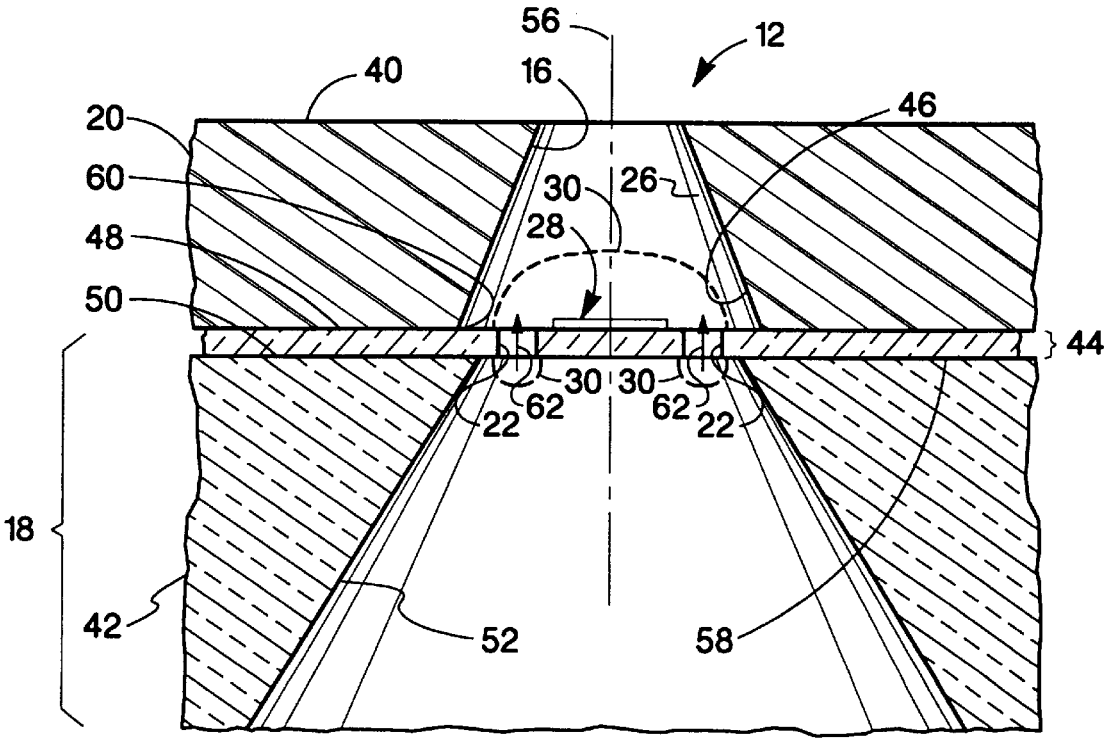
FIG. 4 is an enlarged cross-sectional view of a preferred embodiment of the printhead of FIG. 1 taken across one of the plurality of ink chambers.
Figure 5:
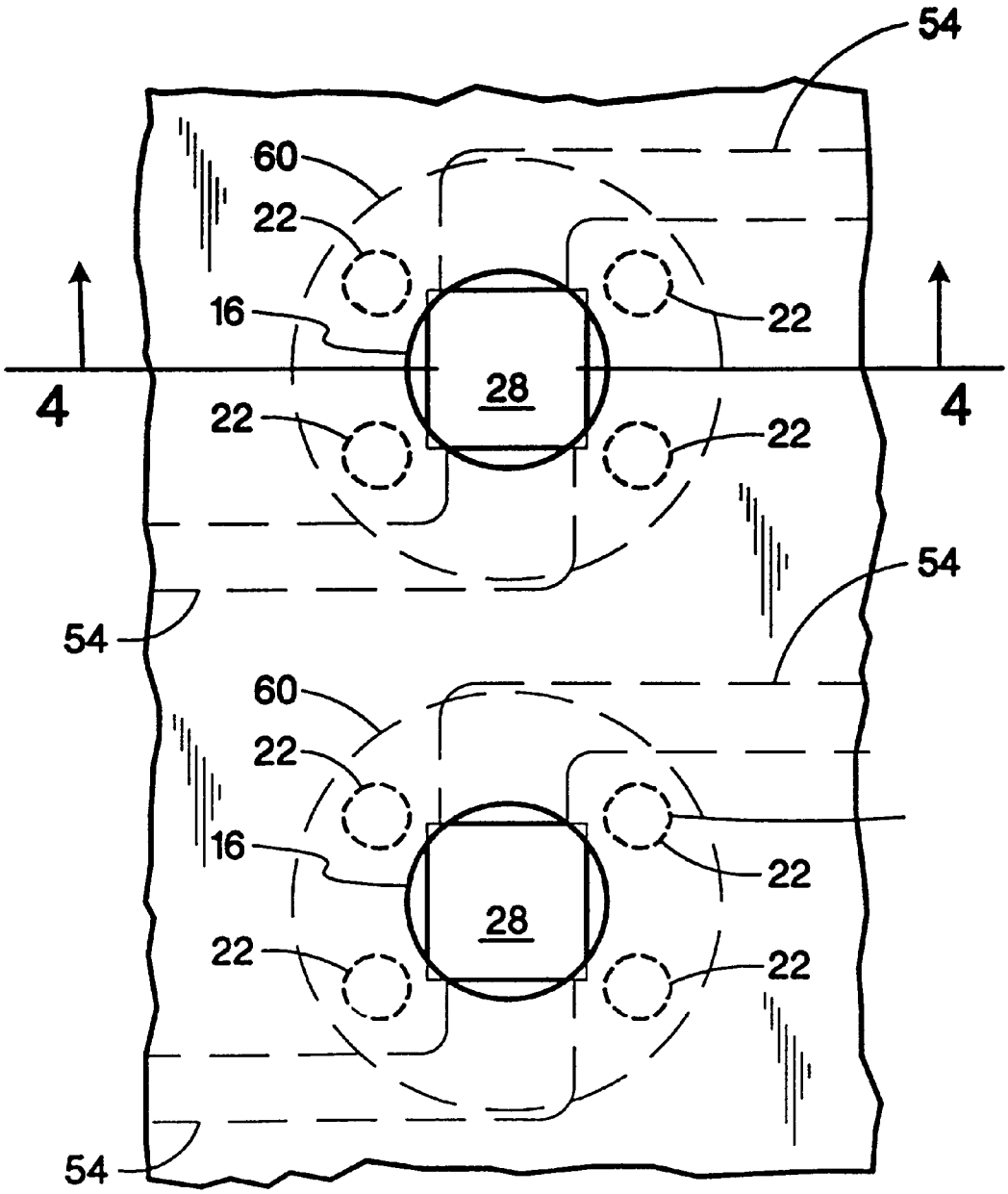
FIG. 5 is a top view of the preferred embodiment of FIG. 4.

FIGS. 4 and 5 depict a preferred embodiment of the printhead 12 of the present invention. The printhead 12 is constructed for drop ejection according to the technique disclosed in FIGS. 3*a,* 3*b,* 3*c,* and 3*d*. FIG. 4 is a greatly enlarged cross-sectional view taken through the printhead and through one of the orifices 16. In FIG. 4, it can be seen that the orifice 16 is formed in an outer surface 40 of the orifice member or plate 20. The orifice member 20 is attached to the substrate 18. The substrate comprises a silicon base 42 and a support layer 44 as described more fully below.

The orifice 16 is an opening through the plate 20 of an fluid chamber 26 that is formed in the orifice plate 20. The diameter of the orifice 16 may be, for example, about 12 to 16 $\mu$m.

In FIG. 4, the chamber 26 is shown with an upwardly tapered sidewall 46, thereby defining a generally frustrum-shaped chamber, the bottom of which is substantially defined by an upper surface 48 of the substrate 18.

It is contemplated that any of a number of fluid chamber shapes will suffice, although the volume of the chamber will generally decrease in the direction toward the orifice 16. In the embodiment of FIG. 4, the orifice plate 20 may be formed using a spin-on or laminated polymer. The polymer may be purchased commercially under the trademark CYCLOTENE from Dow Chemical, having a thickness of about 10 to 30 $\mu$m. Any other suitable polymer film may be used, such as polyamide, polymethylmethacrylate, polycarbonate, polyester, polyamide, polyethylene-terephthalate or mixtures thereof. Alternatively, the orifice may be formed of a gold-plated nickel member manufactured by electrodeposition techniques.

An upper surface 50 of the silicon base 42 is coated with a support layer 44. The support layer 44 is formed of silicon dioxide, silicon nitride, silicon carbide, tantalum, polysilicon glass or other functionally equivalent material having different etchant sensitivity than the silicon base 42 of the substrate.

After the support layer 44 is applied, two fluid inlets 22 are formed to extend through that layer. In a preferred embodiment, the upper surface 48 of the support layer 44 is patterned and etched to form the inlets 22, before the orifice plate 20 is attached to the substrate 18, and before a channel 52 is etched into the base 42 as described below.

A thin-film resistor 28 is attached to the upper surface 48 of the substrate 18. In this preferred embodiment the resistor is applied after the inlets 22 are formed, but before the orifice plate 20 is attached to the substrate 18. The resistor 28 may be about 12 $\mu$m long by 12 $\mu$m wide (see FIG. 5). A very thin (about 0.5 $\mu$m) passivation layer (not shown) may be deposited on the resistor to provide protection from fluids used. This passivation layer may be thinner or may even be eliminated if the fluids are not damaging to the resistor. The overall thickness of the support layer, resistor and passivation layer is about 3 $\mu$m, or less.

The resistor 28 is located immediately adjacent to the inlets 22. The resistor 28 acts as an ohmic heater when selectively energized by a voltage pulse applied to it. In this regard, each resistor 28 contacts at opposing sides of the resistor a conductive trace 54. The traces are deposited on the substrate 18 and are electrically connected to the printer microprocessor for conducting the voltage pulses. The conductive traces 54 appear in FIG. 5.

The preferred orifice plate 20 is laid over the substrate 18 on the upper surface 48 of the support layer 44. In this regard, the plate 20 can be laminated, spun on while in liquid form, grown or deposited in place, or plated in place. The plate 20 adheres to the support layer 44.

The resistor 28 is selectively heated or driven by the microprocessor to generate a vapor bubble having a bubble front 30 (shown in dashed lines in FIG. 4) within the fluid-filled chamber 26. The fluid within the chamber 26 is ejected as a consequence of the expanding bubble front 30 as it travels through a central axis 56 of the orifice 16 and exits the orifice 16 venting the vapor bubble to the atmosphere as shown in FIGS. 3*a*–3*d*. As the bubble front 30 expands through the chamber 26 fluid within the chamber 26 is forced out through orifice 16.

An fluid channel 52 is formed in the base 42 of the substrate 18 to be in fluid communication with the inlets 22. Preferably, the channel 52 is etched by anisotropic etching from the lower side of the base 42 up to an underside 58 of the support layer 44.

In accordance with the present invention, fluid present in the reservoir of the pen body 14 flows by capillary force through each channel 52 and through the inlets 22 to fill the fluid chamber 26. In this regard, the channel 52 has a significantly larger volume than the fluid inlets 22. The channel may be oriented to provide fluid to more than one chamber 26. Each of the channels 52 may extend to connect with an even larger slot (not shown) cut in the substrate base 42 and in direct fluid communication with the pen reservoir. The base 42 of the substrate is bonded to the pen body surface, which surface defines the boundary of the channel 52.

All of the fluid entering the chamber 26 is conducted through the inlets 22. In this regard, a lower end 60 of the chamber 26 completely encircles the inlets 22 and resistor 28.

In the preferred embodiment, the ratio of the volume of the chamber 26 to an area of the heating element 28 is low such that the vapor bubble front expands sufficiently to extend past the orifice 16 plane venting the vapor bubble to atmosphere. For a resistive heating element the energy per unit time or power provided by the heating element 28 is related to a resistor 28 length over a resistor 28 area. For resistors formed of the same length then the power dissipated in the resistor is related to the resistor 28 area. Therefore, the ratio of volume of the chamber 26 to resistor area should be low to ensure that the vapor bubble front 30 vents through the orifice 16 forcing the entire contents of the fluid chamber 26 through the orifice 16.

It is important that as the vapor bubble front 30 expands such that the fluid within the chamber 26 is forced out of the orifice 16 and not into the fluid inlet 22. A ratio of an orifice resistance to blowback resistance should be small to ensure that substantially all of the fluid within the chamber 26 is forced out of the orifice 16 and not into the fluid inlet 22. The orifice resistance in the preferred embodiment is related to the orifice area. The blowback resistance in the preferred embodiment is related to the sum of an area of each of the fluid inlets 22.

Table 1 illustrates simulation results for several different printheads 12 having a variety of different configurations. The printheads shown in Table 1 have resistor areas given in square micrometers and chamber volumes given in microliters. From the data in Table 1 printheads 12 having ratios of chamber volume to resistor area that are as high as 15.6 are suitable for ejecting substantially the entire volume of fluid within the chamber 26 through the orifice 16.

In the preferred embodiment the orifice 16 resistance and the blowback resistance are proportional to their respective lengths divided by their respective areas. Because these lengths are constant both the orifice 16 resistance and blowback resistance can be represented by an orifice 16 area and an inlet 22 area, respectively. The printhead 12 having a ratio of orifice area to inlet area that is as high as 5 is suitable for ejecting substantially the entire volume of fluid within the chamber 26 through the orifice 16. The simulation results shown in table 1 are not intended to represent the full range in which chamber evacuation occurs but merely to illustrate some examples in which chamber evacuation occurs.

TABLE 1

| Resistor Area ($\mu m^2$) | Chamber Volume ($\mu$ liters) | Volume Area | Orifice Area Inlet Area | Drop Velocity (m/s) |
|---|---|---|---|---|
| 100 | 1000 | 10 | .82 | 25 |
| 64 | 1000 | 15.6 | .74 | .22 |
| 196 | 2744 | 14 | 5 | 16.1 |
| 144 | 1728 | 14 | 1.43 | 25 |

In one preferred embodiment, the inlets 22 are located immediately adjacent to the resistor 28 and are sized so that, upon firing, the expanded bubble front 30 occludes the inlets 22 and prevents fluid within the chamber 26 from being blown back into the channel 52. By occluding the inlets 22 the effective blowback resistance is increased allowing more of the fluid within the chamber 26 to be ejected through the orifice.

Specifically, the inlets 22 are contiguous with (not significantly spaced from) the chamber 26 and are located so that the junction of the inlet 22 and the chamber 26 is very near the resistor 28. In a preferred embodiment, each inlet 22 is spaced from the resistor 28 by no more than 25% of the resistor member length.

Moreover, the cross-sectional area of the inlet at the junction of the inlet and the chamber 26 is sized to be sufficiently small to ensure that the expanding bubble front 30 is able to cover, hence occlude, the inlet area. Such occlusion is accomplished by the bubble front 30 when the bubble moves into the inlets 22 and thereby eliminates any liquid-ink pathway between the chamber 26 and the channel 52. As noted earlier, elimination of this pathway prevents the fluid within the chamber 26 from being blown back into the channel 52 as the bubble expands.

The elimination of the liquid pathway is best achieved when the bubble front 30 completely penetrates the inlets 22 and expands slightly into the volume of the channel 52, as shown by the dashed lines in FIG. 4. In a preferred embodiment, the total area of the inlets should be less than about 120% of the area of the resistor.

Occlusion of the inlet(s) by the expanded vapor bubble may occur with printhead configurations unlike those just described in connection with a preferred embodiment. In this regard, the distance of the inlet from the resistor, or heating member, and the cross-sectional area of the inlet may be greater or less than that specified above, depending upon certain variables. Such variables include fluid viscosity and related thermodynamic properties, resistor heat energy per unit of resistor area, and surface energy of the material along which the fluid and vapor move.

In the preferred embodiment, the resistor energy density is about 4 $nJ/m^2$, and the viscosity of the ink is about 3 cp, having a boiling point of about 100 C.

As a consequence of this orientation of the inlets 22 (hence the orientation of the flow paths 62) fluid flowing into the chamber 26 during refill provides flow momentum for lifting the bubble front 30 once the bubble front has breached the orifice plane and vented to atmosphere so that the fluid chamber 26 is filled with fluid as shown in FIGS. 3*c* and 3*d*.

It is noteworthy here that, although in the just described preferred embodiment shown in FIGS. 4 and 5 discloses a particular arrangement of inlets 22 and resistor arrangement, there are a number of different arrangements that can be used. For example, four inlets 22 are depicted in FIG. 5, it will be appreciated that fewer or more inlets may be employed while still meeting the discussed relationship of the chamber volume size, the ratio of chamber volume to resistor area, and ratio of orifice resistance to blowback resistance. In addition, the inlets 22 may have a variety of different arrangements relative to the chamber 26.

There are several advantages to the operation of printhead 12 of the present invention shown in FIGS. 1, 3*a*, 3*b*, 3*c*, 3*d*, 4 and 5. First, the print quality of the printhead 12 of the present invention tends to be improved. The droplet 32 formed by the printhead 12 of the present invention is a single, small droplet that is substantially spherical in shape that is ejected at a high velocity without the formation of streamers 34. By forming droplets 32 without streamers 34, tails are eliminated or greatly reduced. Tails 36 on fluid droplets can result in trajectory errors or pooling which reduce print quality. The higher drop velocity also tends to reduce trajectory errors. Higher drop velocity results in a reduced interval in which the droplet 32 is exposed external forces such as air currents thereby reducing the affect of these external forces on the droplet 32. Additionally, streamers 34 and tails 36 can result in the formation of several smaller droplets which tends to form a spray of ink and not a single droplet. This ink spray tends to result in poor print quality. In contrast, the formation of a single small droplet 32 tends to result in well formed ink spots or marks on print media that are free of puddling and pooling resulting in good print quality.

Secondly, the printhead 12 of the present invention tends to have improved thermal characteristics which allows the printhead to operate at lower turn on energies and have less heat accumulation in the printhead 12. The vapor bubble is vented to the atmosphere in the printhead 12 of the present invention. By venting the vapor bubble collapse of the vapor bubble into the chamber 26 is avoided. Because the vapor bubble does not collapse within the chamber 26 the passivation layer used to protect the heating element 28 from cavitation stresses can be reduced in thickness or eliminated reducing the turn on energy and improving the efficiency or the printhead 12. In addition, venting of the vapor bubble releases the latent heat of condensation into the atmosphere, releasing heat from the printhead 12 thereby preventing the accumulation of heat within the printhead 12. Accumulation of heat within the printhead 12 tends to result in printhead 12 overheating or some limit on printing speed to avoid printhead 12 overheating.

Finally, the printhead 12 of the present invention ejects substantially all of the ink within the chamber 26. Therefore, the droplet size is substantially determined by the chamber 26 size and not by factors which modulate the drop size for the previously used printhead 12' such as resistor size, fluid viscosity and surface tension. Therefore, the printhead 12 of the present invention is capable of providing a more constant drop size independent of various manufacturing variables and ink formulations producing better print quality.

What is claimed is:

1. A printhead for ejecting fluid droplets comprising:

a chamber member defining a chamber having a chamber volume, the chamber member defining an orifice and a fluid inlet through which fluid flows to the chamber;

a heating member located within the chamber for heating fluid within the chamber for ejecting a single fluid droplet having a volume substantially equal to the chamber volume in response to activation of the heating member; and a separate fluid channel which communicates with the chamber by means of the fluid inlet;

wherein the heating of the fluid within the chamber by the heating member forms a vapor bubble with a bubble front that extends outwardly in a radial direction from the heating member, the fluid inlet providing a blowback resistance between the separate fluid channel and the chamber so that the expanding bubble front serves to displace substantially all fluid within the chamber through the orifice to form the fluid droplet; and wherein the vapor bubble front expands through a plane of the orifice until the vapor bubble vents causing discharge of substantially all vapor within the vapor bubble out of the chamber through the orifice to an atmosphere surrounding the printhead causing ejection of the fluid displaced from the chamber through the orifice as the fluid droplet, to prevent cooling of the vapor bubble and subsequent collapse of the vapor bubble within the chamber and onto the heating member.

2. The printhead of claim 1 wherein the orifice has an opening size that is large relative to an opening size associated with the fluid inlet.

3. The printhead of claim 1 wherein the ejected fluid droplet has a velocity associated therewith that is greater than 20 meters per second.

4. The printhead of claim 1 wherein the fluid droplet has a volume that is less than 5 picoliters.

5. The printhead of claim 1 wherein the heating member is a resistor having a resistor area associated therewith, the printhead having a ratio of chamber volume to resistor area that is less than 50 picoliters per square micrometer.

6. The printhead of claim 1 wherein the orifice of the chamber has an orifice resistances and wherein the printhead has a ratio of orifice resistance to fluid inlet blowback resistance that is less than 5.

7. The printhead of claim 6 wherein the orifice resistance is proportional to an orifice area and the blowback resistance is proportional to a fluid inlet area.

8. The printhead of claim 1 wherein the heating member provides sufficient energy relative to the chamber volume for substantially all vapor within the vapor bubble to vent to the atmosphere.

9. The printhead of claim 1 wherein the fluid inlet is occluded by the vapor bubble formed in response to activation of the heating member.

10. A printhead for ejecting fluid droplets comprising:

a chamber member defining a chamber having a chamber volume, the chamber member defining an orifice and a fluid inlet for providing fluid to the chamber;

a heating member located within the chamber for heating fluid within the chamber to form an expanding vapor bubble having a bubble front which expands through a plane of the orifice and forces substantially all of a volume of fluid within the chamber through the orifice, whereupon the expanding vapor bubble vents and substantially all vapor within the expanding vapor bubble is discharged out of the chamber through the orifice to atmosphere ejecting the volume of fluid as a single fluid droplet and preventing cooling of the expanding vapor bubble and subsequent collapse of the expanding vapor bubble within the chamber and onto the heating member;

a separate fluid channel which communicates with the chamber by means of the fluid inlet, the fluid inlet providing a blowback resistance between the separate fluid channel and the chamber; and wherein the orifice has an orifice area providing an orifice resistance and the fluid inlet has an inlet area providing the blowback resistance, and the printhead has a ratio of orifice resistance to blowback resistance that is less than 5.

11. The printhead of claim 10 wherein the single fluid droplet has a volume of less than 5 picoliters.

12. The printhead of claim 10 wherein the single fluid droplet has a fluid volume that is substantially equal to the chamber volume.

13. A method for forming fluid droplets comprising:

providing a chamber member defining a chamber having a chamber volume the chamber member defining an orifice and a fluid inlet through which fluid flows to the chamber;

filling the chamber, through the fluid inlet, with fluid; and heating fluid within the chamber using a heating element within the chamber to form an expanding vapor bubble, the expanding vapor bubble having a bubble front that has an initial position proximate the heating element and a final position proximate the orifice, during expansion from the initial position to the final position, the vapor bubble front expands through a plane of the orifice with the expanding vapor bubble displacing substantially all of a volume of fluid within the chamber through the orifice whereupon the expanding vapor bubble vents and substantially all vapor within the expanding vapor bubble is discharged out of the chamber through the orifice to atmosphere forming a single fluid droplet equal to the chamber volume of the chamber and preventing cooling of the expanding vapor bubble and subsequent collapse of the expanding vapor bubble onto the heating element; and wherein providing the chamber member includes at least predetermining a ratio of the chamber volume to an area of the heating element, predetermining a spacing of the fluid inlet from the heating element and predetermining a cross-sectional area of the fluid inlet at a junction of the fluid inlet to the chamber and of a cross-sectional area of the orifice.

14. The method for forming fluid droplets of claim 13 further including repeating the steps of filling the chamber with fluid and heating fluid within the chamber at a maximum operating frequency that is greater than a maximum operating frequency associated with a corresponding printhead in which the expanding vapor bubble is not vented to atmosphere.

* * * * *

UNITED STATES PATENT AND TRADEMARK OFFICE
CERTIFICATE OF CORRECTION

PATENT NO :6,113,221
DATED :September 5, 2000
INVENTOR(S) :Timothy L. Weber

It is certified that error appears in the above-identified patent and that said Letters Patent are hereby corrected as shown below:

Column 9, line 32 of the Patent, delete "resistances" and insert --resistance--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*